US007779826B2

(12) United States Patent
Lian

(10) Patent No.: US 7,779,826 B2
(45) Date of Patent: Aug. 24, 2010

(54) PAINTBALL GUN

(75) Inventor: Sheng-Jen Lian, Fongyuan (TW)

(73) Assignee: Yao-Gwo Gan, Taichung (TW)

( * ) Notice: Subject to any disclaimer, the term of this patent is extended or adjusted under 35 U.S.C. 154(b) by 0 days.

(21) Appl. No.: 12/202,261

(22) Filed: Aug. 30, 2008

(65) Prior Publication Data

US 2010/0051008 A1 Mar. 4, 2010

(51) Int. Cl.
*F41B 11/00* (2006.01)

(52) U.S. Cl. ..... 124/73; 124/72; 124/75

(58) Field of Classification Search ..... 124/72, 124/73, 75

See application file for complete search history.

(56) References Cited

U.S. PATENT DOCUMENTS

| | | | | |
|---|---|---|---|---|
| 5,613,483 | A * | 3/1997 | Lukas et al. | 124/73 |
| 2004/0089280 | A1 * | 5/2004 | Kunimoto | 124/76 |
| 2007/0163564 | A1 * | 7/2007 | Gan | 124/73 |
| 2009/0145413 | A1 * | 6/2009 | Li | 124/73 |

* cited by examiner

*Primary Examiner*—Michael Carone
*Assistant Examiner*—Daniel J Troy
(74) *Attorney, Agent, or Firm*—Banger Shia

(57) ABSTRACT

A paintball gun which is simplified in structure and improved in gas efficiency comprises a two-stage pneumatic propulsion, a rear end of the paintball feeder is engaged in an inner groove of the pushing rod, such arrangements facilitates smooth flow of the gas in the barrel of the paintball gun and simplification of the structure.

6 Claims, 6 Drawing Sheets

PAINTBALL GUN

BACKGROUND OF THE INVENTION

1. Field of the Invention

The present invention relates to a paintball gun.

2. Description of the Prior Art

In order to improve the gas efficiency and power of a paintball gun, someone has proposed to make a two-stage pneumatic propulsion device to increase the firing power.

Referring to FIG. 1, a conventional paintball gun 1 with a two-stage pneumatic propulsion device is shown and comprises a barrel 2 in which a pushing rod 4 and a paintball feeder 5 are disposed. Furthermore, the barrel 2 is connected to one end of a valve by a passage 6, and the other end of the valve is connected to an air supply portion.

The pushing rod 4 is a conical structure in the outer surface of which is defined an air guiding route 8 connected to the rear end of the pushing rod 4. The rear end of the pushing rod 4 is formed with a first protruding portion 9 and a positioning portion 10 extending from the first protruding portion 9. The positioning portion 10 abuts against a cover so as to define a first gas chamber 12 between the cover 11 and the pushing rod 4. In the barrel 2 is formed a first stop portion 13, and at the rear end of the first stop portion 13 is further defined a through hole 14 which is communication with the interior space of the barrel 2 and the passage 6, so that the gas of the passage 6 can be pushed to the rear end of the pushing rod 4 via the through hole 14, and the pushing rod 4 moves along a first travel path between a first position and a second position.

The paintball feeder 5 is defined with a gas channel 15 in communication with the muzzle of the gun, and the pushing rod 4 is abutted against the rear end of the paintball feeder 5 so as to close the gas channel 15. The paintball feeder 5 includes a second protruding portion 16, and in the barrel 2 is further formed a second stop portion 17. The paintball feeder 5 is allowed to move along a second travel path between a first position and a second position.

When the valve is opened, gas will be supplied from the air supply portion via the passage 6 to push the pushing rod 4 to the second position from the first position, and the front end of the pushing rod 4 will simultaneously push the paintball feeder 5 to move from the first position to the second position, indirectly making the paintball feeder 5 propel the paintball. Since the second travel path is longer than the first travel path, the first protruding portion 9 will be pressed against the first stop portion 13 as the pushing rod 4 moves to the second position. At this moment, the gas will keep pushing the rear end of the paintball feeder 5 to move forward, thus opening the gas channel 15 and creating a strong firing power.

However, since such a paintball gun is provided with a passage outside the pushing rod for the flow of the gas, it must arrange an inner pipe inside the barrel to restrict the flowing route of the gas. Moreover, friction will be caused when the gas flowing through the unsmooth inner surface of the inner pipe, thus reducing the gas efficiency.

The present invention has arisen to mitigate and/or obviate the afore-described disadvantages.

SUMMARY OF THE INVENTION

The primary objective of the present invention is to provide a paintball gun. The paintball comprises a barrel and a valve. The valve is provided with a passage for allowing gas to flow to the barrel. In the barrel is disposed a paintball feeder and a pushing rod, in the paintball feeder is defined a gas channel for allowing gas to be outputted from the passage, the pushing rod is abutted against a rear end of the paintball feeder to close the gas channel. Gas from the passage is able to flow to a rear end of the pushing rod to push the pushing rod to move within a first travel between a first position and a second position. The paintball feeder is able to move along a second travel between a third position and a fourth position. The first travel is longer than the second travel, so when the pushing rod is pushed to the second position, the paintball feeder will be pushed by the gas of the passage to move away from the pushing rod and to open the air channel, so that the gas of the passage will be outputted from the air channel to fire the paintball. The paintball gun is characterized in that: a front end of the pushing rod is formed with an inner groove, and the pushing rod is further provided with a hole for connecting the inner groove and the rear end of the pushing rod, an inner diameter of the inner groove is larger than an outer diameter of the paintball feeder, the rear end of the paintball feeder is engaged in the inner groove.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
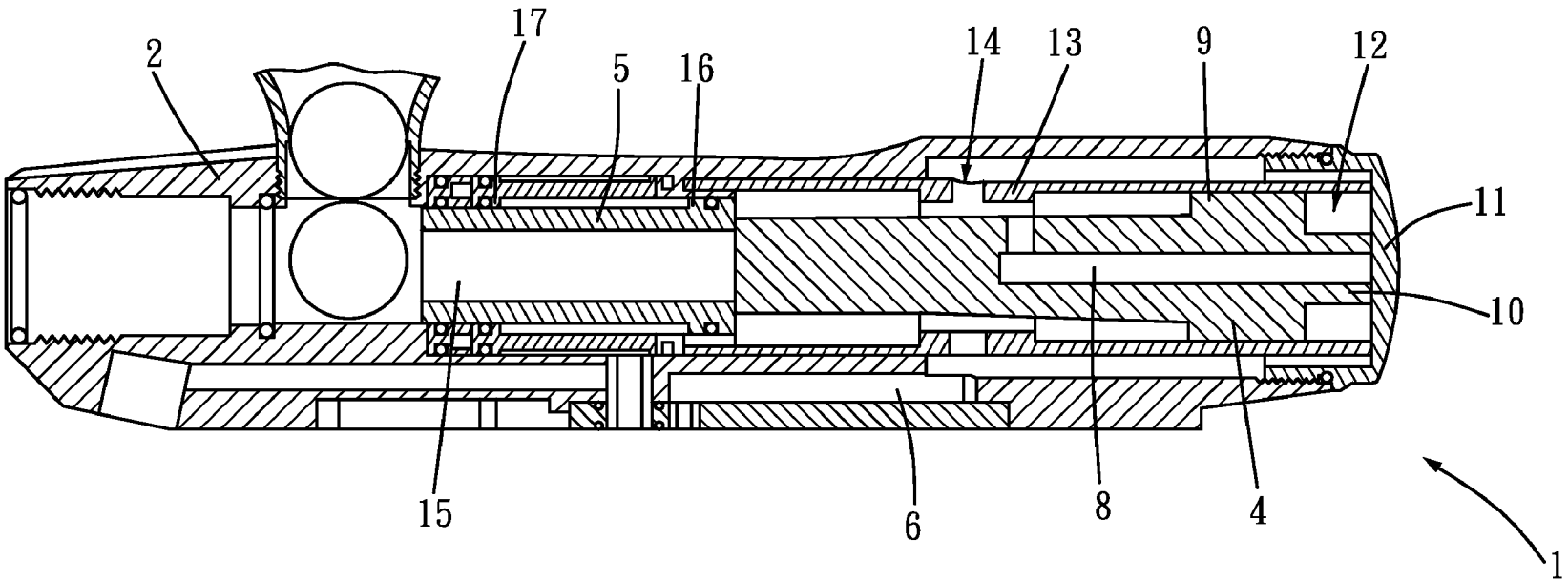
FIG. 1 PRIOR ART
FIG. 1 is a cross sectional view of a conventional paintball gun.
Figure 2:
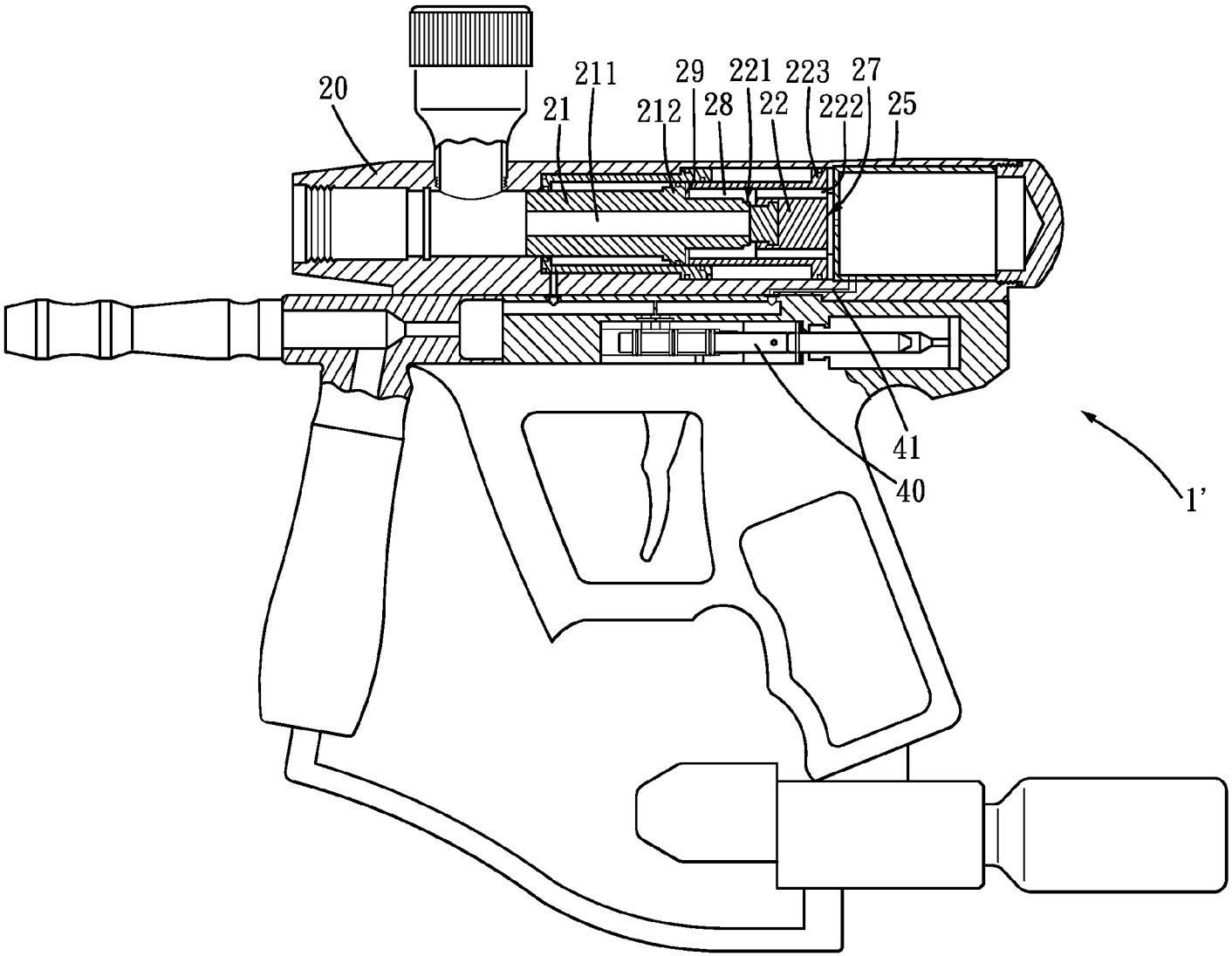
FIG. 2 shows a paintball gun in accordance with the present invention.
Figure 3:
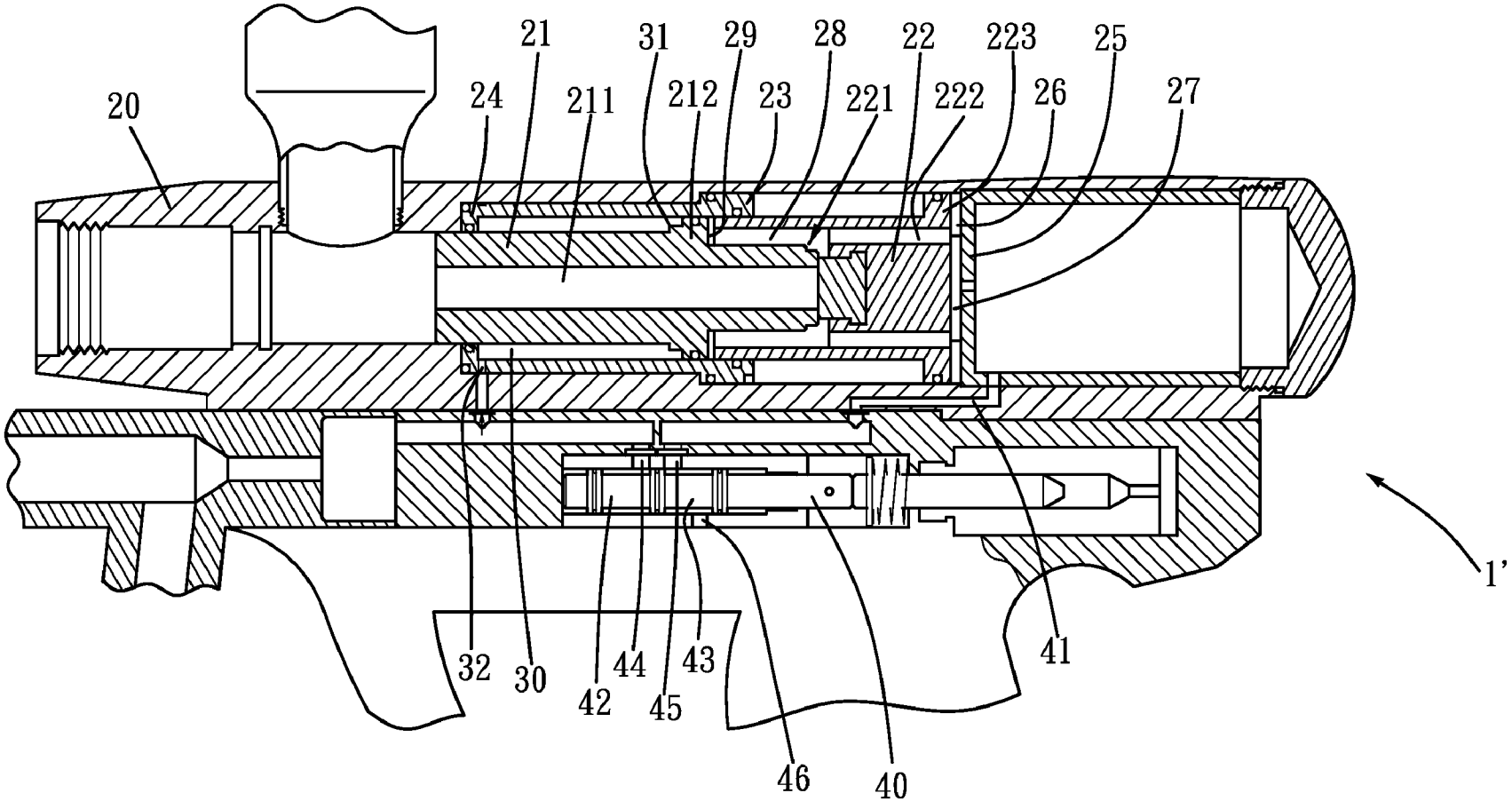
FIG. 3 shows the non-firing state of the paintball gun in accordance with the present invention.

Referring to FIGS. 2 and 3, a paintball gun in accordance with the present invention comprises a barrel 20 and a valve 40. The valve 40 is provided with a passage 41 for allowing the gas to flow to the barrel 20. In the barrel 20 are further disposed a paintball feeder 21 and a pushing rod 22. In the paintball feeder 21 is defined a gas channel 211 for allowing gas to be outputted from the passage 41. In the front end of the pushing rod 22 is formed an inner groove 221, and the pushing rod 22 is further provided with a hole 222 for connecting the inner groove 221 and the rear end of the pushing rod 22. The inner diameter of the inner groove 221 is larger than the outer diameter of the paintball feeder 21. The rear end of the paintball feeder 21 is engaged and positioned in the inner groove 221 to close the gas channel 211. Moreover, the pushing rod 22 includes a first protruding portion 223, the paintball feeder 21 includes a second protruding portion 212, and in the barrel 20 are formed a first stop portion 23 and a second stop portion 24. The first protruding portion 223 is abutted against the first stop portion 23, and the second protruding portion 212 is rested against the second stop portion 24. In the barrel 20 is further provided a separating board 25 which is located at the rear end of the pushing rod 22. A first gas chamber 26 is defined between the pushing rod 22 and the separating board 25. The vertical contacting surface of the pushing rod 22 with respect to the first gas chamber 26 is defined as a first pushing surface 27. A second gas chamber 28 is defined between the inner groove 221 and the rear end of the paintball feeder 21, and a vertical contacting surface at the rear end of the paintball feeder 21 for contacting the second gas chamber 28 is a second pushing surface 29. The front end of the second protruding portion 212 is a stepped structure, between the second protruding portion 212 and the second stop portion 24 is defined a third gas chamber 30, and the vertical contacting surface of the second protruding portion 212 for contacting the third gas chamber 30 is a third pushing surface 31. The first pushing surface 27 is larger than the second pushing surface 29, and the second pushing surface 29 is larger than the third pushing surface 31. In this present invention, the vertical contacting surface is defined as the contacting surface which is vertical to the length direction of the barrel.

Furthermore, the valve 40 is defined with a front groove 42, a rear groove 43, a first groove hole 44, a second groove hole 45 and a discharge hole 46. The first groove hole 44 is connected to an air supply portion, the second groove hole 45 is in communication with the passage 41, and the discharge hole 46 is connected to outside. The third gas chamber 30 is defined with an air supply passage 32 which is connected to the air supply portion for continuously providing a propulsion to the third pushing surface 31.

Figure 4:
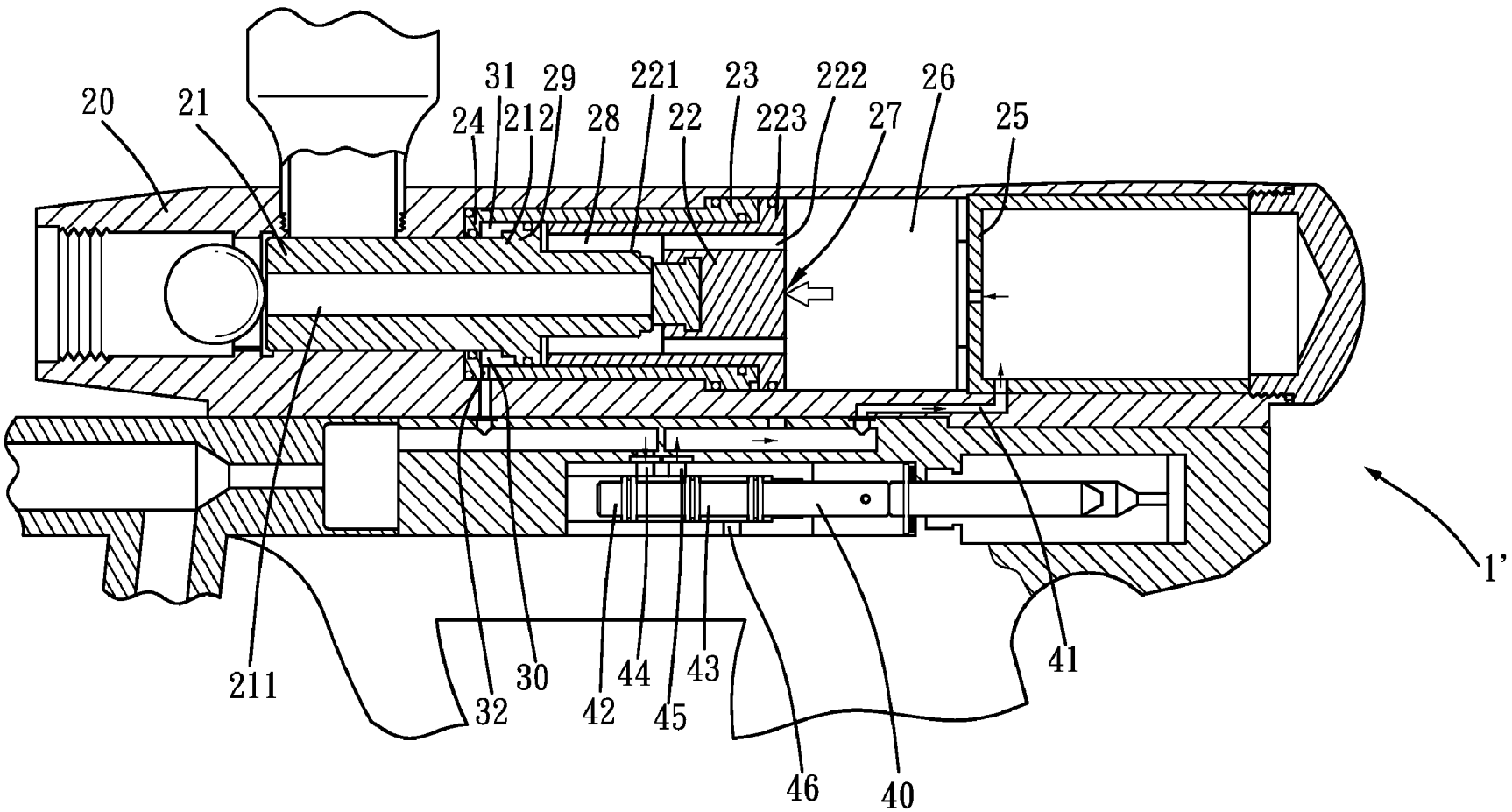
FIG. 4 shows the ready-to-fire state of the paintball gun in accordance with the present invention.
Figure 5:
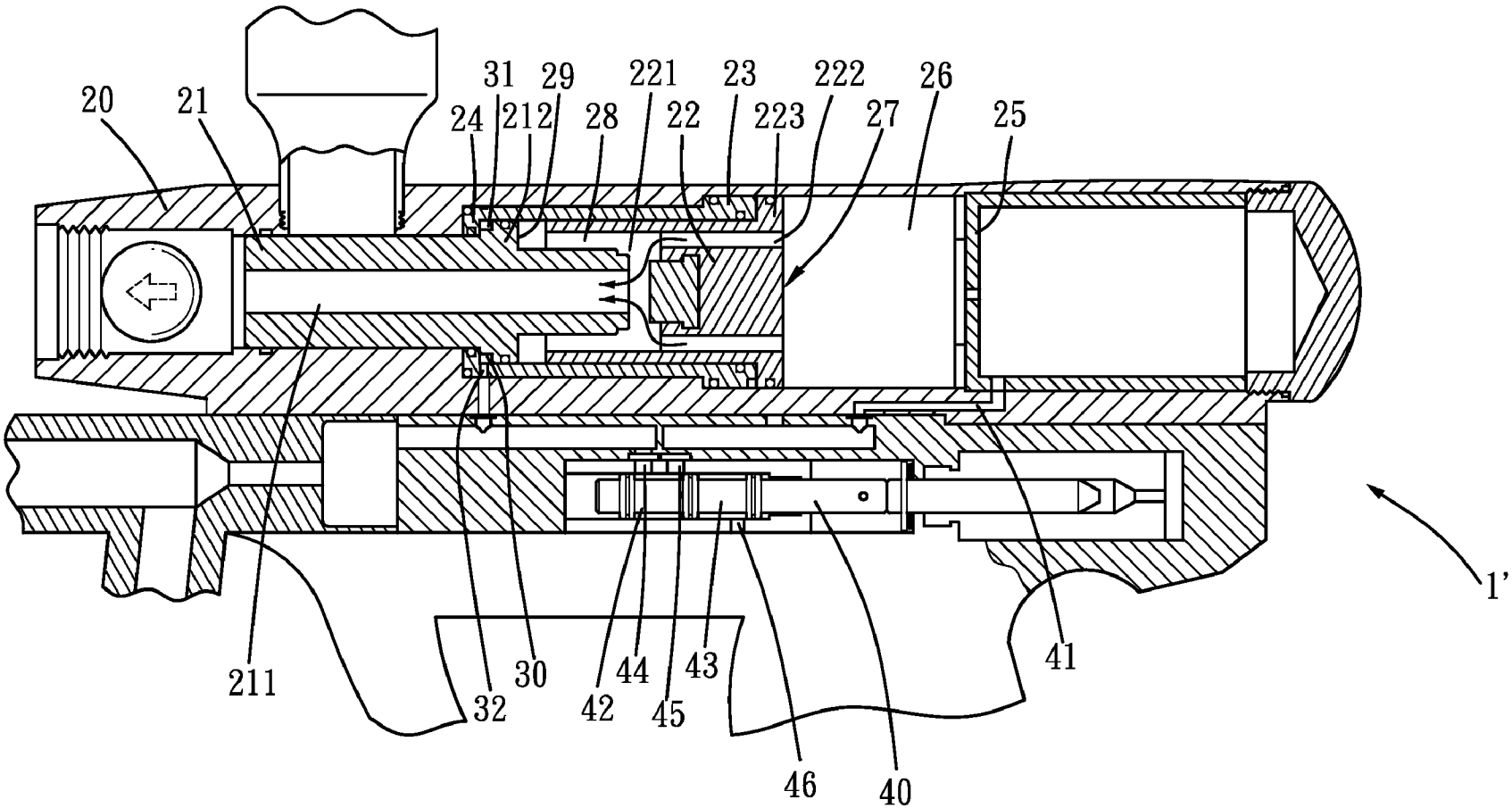
FIG. 5 shows the firing state of the paintball gun in accordance with the present invention.
Figure 6:
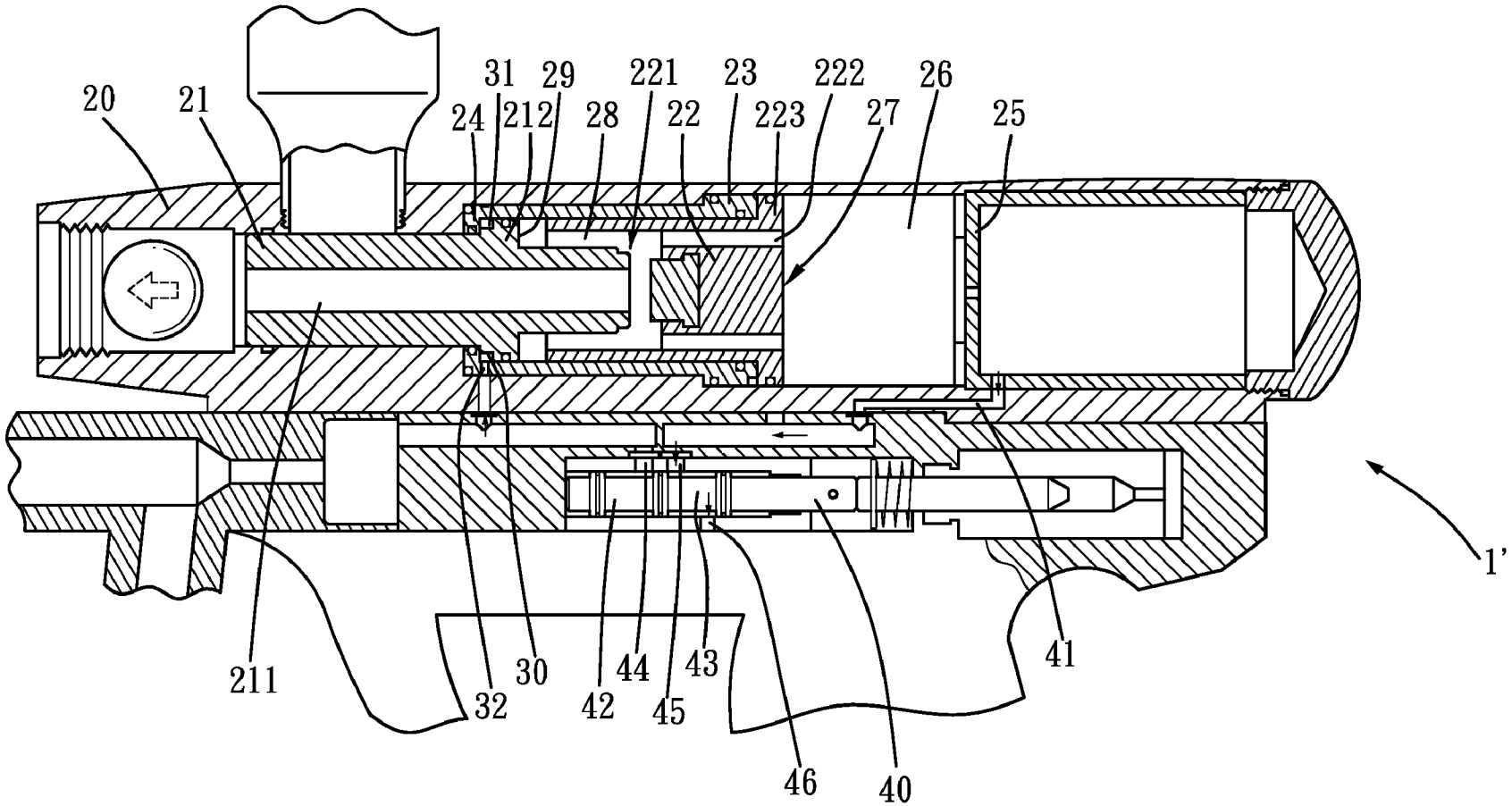
FIG. 6 shows that the paintball gun in accordance with the present invention returns to the non-firing state.

For a better understanding of the firing operation of the present invention, reference should be made to FIGS. 3-6. Referring first to FIG. 3, before firing (non-firing state), the gas flows from the air supply passage 32 to the third gas chamber 30 to provide a push force toward the third pushing surface 31, enabling the paintball feeder 21 and the pushing rod 22 to move to the first position in the second travel and the first position in the first travel. At this moment, the paintball to be fired is able to move to the front end of the paintball feeder 21 via the paintball feeding port. Referring then to FIG. 4, when the paintball gun 1 is in the firing state, the front groove 42 is in communication with the first groove hole 44 and the second groove hole 45, at this moment, the gas supplied from the air supply portion will flow along the passage 41 into the first gas chamber 26 at the rear end of the pushing rod 22 and push the pushing rod 22 to move to the second position in the first travel, namely, the first protruding portion 223 will be abutted against the first stop portion 23 while pushing paintball feeder 21 to move forward to close the paintball feeding port. Referring further to FIG. 5, while pushing the pushing rod 22 to move, the gas of the first gas chamber 26 will also flow through the hole 222 into the second gas chamber 28 to push the paintball feeder 21 to the second position in the second travel, namely, the second protruding portion 212 will be abutted against the second stop portion 24 while opening the gas channel 211, so that the gas of the passage 41 will flow into the gas channel 211 to fire the paintball. Finally, referring to FIG. 6, the instant the firing is completed, the valve 40 will return to its non-firing state, allowing the rear groove 43 to be communicated with the second groove hole 45 and the discharge hole 46 while releasing the air pressure of the first gas chamber 26 and the second gas chamber 28. Furthermore, at this moment, since the gas of the third gas chamber 30 still keeps providing a pushing force toward the third pushing surface 31, it definitely will push the paintball feeder 21 and the pushing rod 22 to move backward to the first position in the second travel and to the first position in the first travel, namely, making the paintball gun 1' return to the non-firing state.

As compared to the conventional two-stage pneumatic propulsion type paintball gun, the present invention has the following advantages:

First, inside of the pushing rod is defined the passage in communication with the first and second gas chambers, therefore, the diameter, size, surface-smoothness of the passage can be more precisely controlled, thus avoiding the loss of gas efficiency.

Second, the passage of the conventional pushing rod is defined by the outer surface of the pushing rod and the inner pipe outside the pushing rod, therefore, it needs an inner pipe to restrict the air-flow direction of the gas flowing through the passage. However, the pushing rod of the present invention is defined with an inner groove, and the passage is also located inside the pushing rod, hence, the present invention does not need an extra inner pipe, thus simplifying the structure while reducing the production cost.

Third, the front end of the second protruding portion is a stepped structure, the purpose of such a structure is that when a part of the second protruding portion is abutted against the second stop portion, gas can still flow through the air supplying passage into the third gas chamber while providing a pushing force toward the third pushing surface, so as to push the paintball feeder backward without requiring an extra spring to push the paintball feeder to move backward. Except improving the gas efficiency, such a structure also contributes to simplify the assembly and cost of the paintball gun.

While we have shown and described various embodiments in accordance with the present invention, it is clear to those skilled in the art that further embodiments may be made without departing from the scope of the present invention.

What is claimed is:

1. A paintball gun comprising a barrel and valve, the valve being provided with a passage for allowing gas to flow to the barrel;

in the barrel being disposed a paintball feeder and a pushing rod, in the paintball feeder being defined a gas channel for allowing gas to be outputted from the passage, the pushing rod abutting against a rear end of the paintball feeder to close the gas channel;

gas from the passage being able to flow to a rear end of the pushing rod to push the pushing rod to move within a first travel between a first position and a second position;

the paintball feeder being able to move along a second travel between a third position and a fourth position;

the second travel is longer than the first travel, so when the pushing rod is pushed to the second position, the paintball feeder will be pushed by the gas of the passage to move away from the pushing rod and to open the air channel, so that the gas of the passage will be outputted from the air channel to fire paintballs and the paintball gun is characterized in that: a front end of the pushing rod is formed with an inner groove, and the pushing rod is further provided with a hole for linearly connecting the inner groove and the rear end of the pushing rod, an inner diameter of the inner groove is larger than an outer diameter of the paintball feeder, the rear end of the paintball feeder is engaged in the inner groove.

2. The paintball gun as claimed in claim 1, wherein in the barrel is further provided a separating board which is located at the rear end of the pushing rod, a first gas chamber is defined between the pushing rod and the separating board, a vertical contacting surface of the pushing rod with respect to the first gas chamber is defined as a first pushing surface, a second gas chamber is defined between the inner groove and the rear end of the paintball feeder, and a vertical contacting surface at the rear end of the paintball feeder for contacting the second gas chamber is a second pushing surface, the first pushing surface is larger than the second pushing surface.

3. The paintball gun as claimed in claim 2, wherein the rear end of the pushing rod is formed with a first protruding portion, the paintball feeder is provided with a second protruding portion, in the barrel is further formed a first stop portion and a second stop portion, the first protruding portion is to be pressed against the first stop portion, and the second protruding portion is to be pressed against the second stop portion.

4. The paintball gun as claimed in claim 3, wherein a front end of the second protruding portion is a stepped structure, between the second protruding portion and the second stop portion is defined a third gas chamber, a vertical contacting surface of the second protruding portion for contacting the third gas chamber is a third pushing surface, the second pushing surface is larger than the third pushing surface, the third gas chamber is defined with an air supply passage which is connected to the air supply portion for continuously providing a propulsion to the third pushing surface.

5. The paintball gun as claimed in claim 1, wherein the rear end of the pushing rod is formed with a first protruding portion, the paintball feeder is provided with a second protruding portion, in the barrel is further formed a first stop portion and a second stop portion, the first protruding portion is to be pressed against the first stop portion, and the second protruding portion is to be pressed against the second stop portion.

6. The paintball gun as claimed in claim 1, wherein the valve is defined with a front groove, a rear groove, a first groove hole, a second groove hole and a discharge hole, the first groove hole is connected to an air supply portion, the second groove hole is in communication with the passage, and the discharge hole is connected to outside, when the paintball feeder is in a firing state, the front groove is opened with respect to the first groove hole and the second groove hole, and when the paintball feeder is in a non-firing state, the rear groove communicates with the second groove hole and discharge hole.

* * * * *